US007030843B2

(12) United States Patent
Youn

(10) Patent No.: US 7,030,843 B2
(45) Date of Patent: Apr. 18, 2006

(54) LIQUID CRYSTAL DISPLAY WITH MULTI-FRAME INVERTING FUNCTION AND AN APPARATUS AND A METHOD FOR DRIVING THE SAME

(75) Inventor: Won-Bong Youn, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 222 days.

(21) Appl. No.: 09/953,308

(22) Filed: Sep. 17, 2001

(65) Prior Publication Data

US 2002/0089485 A1 Jul. 11, 2002

(30) Foreign Application Priority Data

Nov. 22, 2000 (KR) ..... 2000-69724

(51) Int. Cl.
*G09G 3/36* (2006.01)

(52) U.S. Cl. ..... 345/86; 345/209

(58) Field of Classification Search ..... 345/96, 345/209, 87, 99; 745/92
See application file for complete search history.

(56) References Cited

U.S. PATENT DOCUMENTS 6,335,721 B1 * 1/2002 Jeong ..... 345/100
6,342,876 B1 * 1/2002 Kim ..... 345/87
6,400,350 B1 * 6/2002 Nishimura et al. ..... 345/96
6,417,827 B1 * 7/2002 Nagao et al. ..... 345/89
6,538,631 B1 * 3/2003 Kwon ..... 345/96
6,628,274 B1 * 9/2003 Morita ..... 345/209

* cited by examiner

*Primary Examiner*—Henry N. Tran

(57) ABSTRACT

A liquid crystal display (LCD) device, can include a timing controller with a multiframe inversion driving portion for modulating an REV signal that designates a polarity of a data voltage for switching the polarity of liquid crystals on an LCD panel with respect to a common electrode voltage, thereby generating a modulated REV signal; a gate driver generates a gate driving voltage; a data driver for generating a data driving voltage based on the modulated REV signal received from the timing controller; and an LCD panel repeats an inversion drive in a period of p frames based on the gate driving voltage and the data driving voltage, the inversion being shifted down by every line in a period of one frame according to a change in the frame.

29 Claims, 8 Drawing Sheets

FIG.1

FRAME n

| | | | | | | | | |
|---|---|---|---|---|---|---|---|---|
| G1 | + | − | + | − | + | − | + | − |
| G2 | − | + | − | + | − | + | − | + |
| G3 | + | − | + | − | + | − | + | − |
| G4 | − | + | − | + | − | + | − | + |
| G5 | + | − | + | − | + | − | + | − |
| G6 | − | + | − | + | − | + | − | + |
| G7 | + | − | + | − | + | − | + | − |
| G8 | − | + | − | + | − | + | − | + |
| G9 | + | − | + | − | + | − | + | − |
| G10 | − | + | − | + | − | + | − | + |
| G11 | + | − | + | − | + | − | + | − |

FRAME n+1

| | | | | | | | | |
|---|---|---|---|---|---|---|---|---|
| G1 | − | + | − | + | − | + | − | + |
| G2 | + | − | + | − | + | − | + | − |
| G3 | − | + | − | + | − | + | − | + |
| G4 | + | − | + | − | + | − | + | − |
| G5 | − | + | − | + | − | + | − | + |
| G6 | + | − | + | − | + | − | + | − |
| G7 | − | + | − | + | − | + | − | + |
| G8 | + | − | + | − | + | − | + | − |
| G9 | − | + | − | + | − | + | − | + |
| G10 | + | − | + | − | + | − | + | − |
| G11 | − | + | − | + | − | + | − | + |

FIG.2

FRAME n

| | | | | | | | | |
|---|---|---|---|---|---|---|---|---|
| G1 | + | − | + | − | + | − | + | − |
| G2 | + | − | + | − | + | − | + | − |
| G3 | − | + | − | + | − | + | − | + |
| G4 | − | + | − | + | − | + | − | + |
| G5 | + | − | + | − | + | − | + | − |
| G6 | + | − | + | − | + | − | + | − |
| G7 | − | + | − | + | − | + | − | + |
| G8 | − | + | − | + | − | + | − | + |
| G9 | + | − | + | − | + | − | + | − |
| G10 | + | − | + | − | + | − | + | − |
| G11 | − | + | − | + | − | + | − | + |

FRAME n+1

| | | | | | | | | |
|---|---|---|---|---|---|---|---|---|
| G1 | − | + | − | + | − | + | − | + |
| G2 | − | + | − | + | − | + | − | + |
| G3 | + | − | + | − | + | − | + | − |
| G4 | + | − | + | − | + | − | + | − |
| G5 | − | + | − | + | − | + | − | + |
| G6 | − | + | − | + | − | + | − | + |
| G7 | + | − | + | − | + | − | + | − |
| G8 | + | − | + | − | + | − | + | − |
| G9 | − | + | − | + | − | + | − | + |
| G10 | − | + | − | + | − | + | − | + |
| G11 | + | − | + | − | + | − | + | − |

Frame N

| | | | | | |
|---|---|---|---|---|---|
| + | − | + | − | + | − |
| + | − | + | − | + | − |
| − | + | − | + | − | + |
| − | + | − | + | − | + |
| + | − | + | − | + | − |
| + | − | + | − | + | − |

Frame N+1

| | | | | | |
|---|---|---|---|---|---|
| − | + | − | + | − | + |
| + | − | + | − | + | − |
| + | − | + | − | + | − |
| − | + | − | + | − | + |
| − | + | − | + | − | + |
| + | − | + | − | + | − |

Frame N+2

| | | | | | |
|---|---|---|---|---|---|
| − | + | − | + | − | + |
| − | + | − | + | − | + |
| + | − | + | − | + | − |
| + | − | + | − | + | − |
| − | + | − | + | − | + |
| − | + | − | + | − | + |

Frame N+3

| | | | | | |
|---|---|---|---|---|---|
| + | − | + | − | + | − |
| − | + | − | + | − | + |
| − | + | − | + | − | + |
| + | − | + | − | + | − |
| + | − | + | − | + | − |
| − | + | − | + | − | + |

Frame N

| | | | | | |
|---|---|---|---|---|---|
| + | + | + | + | + | + |
| + | − | + | − | + | − |
| − | − | − | − | − | − |
| − | + | − | + | − | + |
| + | + | + | + | + | + |
| + | − | + | − | + | − |

Frame N+1

| | | | | | |
|---|---|---|---|---|---|
| + | + | + | + | + | + |
| − | + | − | + | − | + |
| − | − | − | − | − | − |
| + | − | + | − | + | − |
| + | + | + | + | + | + |
| − | + | − | + | − | + |

Frame N+2

| | | | | | |
|---|---|---|---|---|---|
| − | − | − | − | − | − |
| + | − | + | − | + | − |
| + | + | + | + | + | + |
| − | + | − | + | − | + |
| − | − | − | − | − | − |
| + | − | + | − | + | − |

Frame N+3

| | | | | | |
|---|---|---|---|---|---|
| − | − | − | − | − | − |
| − | + | − | + | − | + |
| + | + | + | + | + | + |
| + | − | + | − | + | − |
| − | − | − | − | − | − |
| − | + | − | + | − | + |

LIQUID CRYSTAL DISPLAY WITH MULTI-FRAME INVERTING FUNCTION AND AN APPARATUS AND A METHOD FOR DRIVING THE SAME

BACKGROUND OF THE INVENTION (a) Field of the Invention

The present invention relates to a liquid crystal display (LCD) device, and an apparatus and method for driving the same. More specifically, the present invention relates to an LCD having a multiframe inverting function, and an apparatus and method for driving the same.

(b) Description of the Related Art

As personal computers or televisions have recently become more light-weighted and thinner, LCDs are required to have smaller weight and thickness. For this reason, flat panel type display devices such as LCD are used as a substitute for a cathode ray tube (CRT) and put to practical uses in various applications.

LCD is a display device in which electric field is supplied to a liquid crystal material having an anisotropic dielectric constant between two substrates and controlled to regulate the amount of light passing through the substrates, thereby generating a desired image signal.

LCD is a representative of portable flat-panel type display devices, among which TFT (Thin Film Transistor)-LCD using an array of TFTs as a switching element is most widely used.

Typically, LCD includes a plurality of gate lines for transmitting a scanning signal, a plurality of data lines intersecting the gate lines and transmitting image data, and a plurality of pixels each formed at a region surrounded by the gate lines and the data lines and connected to the gate lines and the data lines via switching elements in the matrix form.

In the LCD, image data are supplied to the individual pixels as follows.

First, a gate-on signal, i.e., scanning signal is sequentially supplied to the gate lines to turn on the switching elements connected to the gate lines in sequence and, simultaneously, to provide image signals to be supplied to pixel rows corresponding to the gate lines, i.e., supply a gradation voltage to the respective data lines. The image signals supplied to the data lines are supplied to the individual pixels via the switching elements turned on. The gate-on signal is sequentially supplied to all gate lines for one frame so as to display an image of one frame.

It is necessary to invert the gradation voltage with respect to a common voltage, because of the problematic characteristic of the liquid crystal material that the liquid crystal material is degraded under the electric field continuously supplied in one direction. Namely, when a signal voltage positive in polarity is supplied to a pixel, a negative signal voltage has to be supplied to the next frame.

For this purpose, the TFT-LCD is inverted on a frame-by-frame basis (in the frame inversion method (FIM)), on a line-by-line basis (in the line inversion method (LIM)), on a column-by-column basis (in the column inversion method (CIM)), or on a pixel-by-pixel basis (in the dot inversion method (DIM)).

These inversion methods make use of the fact that the averaged brightness of the individual dots in a given area is constant because the human eyes recognize different dots at the same time. The methods are so effective in general displays as not to make the users feel inconvenient, but flickering occurs when displaying the same patterns as the inversion methods. Flickering refers to a quality-related characteristic of the picture that appears in the presence of a transmittivity difference between the two polarities in periodically switching the charging polarity of liquid crystals between positive (+) and negative (−) polarities. Flickering occurs when the same voltage cannot be supplied to the individual dots due to RC delay that depends on the length of the panel, because the individual dots are distributed in area and a control voltage for each dot is supplied in one direction.

That is, flickering occurs in the horizontal pattern for line inversion, in the vertical pattern for column inversion, and in the dot pattern for dot inversion, because human eyes recognize these patterns in the same way as the pattern in frame inversion.

It is however still problematic in that the horizontal, vertical and dot patterns are all included in the range of the user screen.

In an attempt to overcome this problem, there is suggested the 2×1 dot inversion method as illustrated in FIG. 2, in which positive (+) and negative (−) voltages are viewed in a pattern included in the range of the user screen to reduce flickering. This method eliminates flickering from all user screens because the user scarcely uses the 2×1 dot screen that shows flickering. The 2×1 dot inversion method may drive the LCD module with the flickering a lot less noticed, but creates blurred horizontal lines in the screen due to a difference in the charging rate between the odd and even lines.

For example, when the data voltage wavelength is input in the form of pulses with a four-line period, the head of the waveform is delayed due to resistance and capacitance of the data lines, which leads to a delay of the pixel voltage corresponding to the odd lines.

The pixel voltage corresponding to the even lines is also delayed in the next frame for the same reason except that the voltage is in a low state.

The reasons why the head of the waveform is delayed are also considered as that the gate waveform is recognized differently from even lines to odd lines in correlation with data when the waveform varies due to the RC delay of the gate lines, and that the pixel voltage at the head of the waveform differs from odd lines to even lines in connecting an auxiliary capacitance Cst to the gate of the head to drive the auxiliary capacitance.

For these reasons, horizontal lines are created in displaying a screen with an intermediate gradation brightness, which eventually deteriorates the quality of the image.

SUMMARY OF THE INVENTION

It is a first object of the present invention to solve the problem and to provide an LCD having a multiframe inverting function that reduces flickering and horizontal lines in driving a single bank type LCD.

It is a second object of the present invention to provide an LCD having a multiframe inverting function that reduces flickering and horizontal lines in driving a dual bank type LCD.

It is a third object of the present invention to provide an apparatus for driving an LCD having a multiframe inverting function that reduces flickering and horizontal lines in driving a single bank type LCD.

It is a fourth object of the present invention to provide an apparatus for driving an LCD having a multiframe inverting function that reduces flickering and horizontal lines in driving a dual bank type LCD.

It is a fifth object of the present invention to provide a method for driving an LCD having a multiframe inverting function that reduces flickering and horizontal lines in driving a single bank type LCD.

It is a sixth object of the present invention to provide a method for driving an LCD having a multiframe inverting function that prevent flickering and horizontal lines in driving a dual bank type LCD.

In one aspect of the present invention to achieve the first object, there is provided an LCD having a multiframe inversion function, which performs an inversion drive of every frame to be opposite in polarity to the previous one, the LCD including: a timing controller having a multiframe inversion driving portion for modulating a reversal (REV) signal that designates a polarity of a data voltage for switching the polarity of liquid crystals on an LCD panel with respect to a common electrode voltage, thereby generating a modulated REV signal; a gate driver for generating a gate driving voltage; a data driver for generating a data driving voltage based on the modulated REV signal received from the timing controller; and an LCD panel having a plurality of gate lines for transferring scanning signals, a plurality of data lines intersecting the gate lines for transferring image signals, a plurality of switching elements each formed in an area surrounded by the gate lines and the data lines and connected to the gate lines and the data lines, and a plurality of dot electrodes connected to the switching elements and operable in response to the operations of the switching elements, wherein the inversion drive repeats in a period of p frames based on the gate driving voltage and the data driving voltage (where p is an integer equal to or greater than 4), the inversion being shifted down by every line in a period of one frame according to a change in the frame.

In another aspect of the present invention to achieve the second object, there is provided an LCD having a multiframe inversion function, which performs an inversion drive of every frame to be opposite in polarity to the previous one, the LCD including: a timing controller having a multiframe inversion driving portion for modulating a REV signal that designates a polarity of a data voltage supplied to an LCD panel, individually every odd/even column, and generating a modulated odd REV signal and a modulated even REV signal designating the polarities of odd and even data voltages, respectively; a gate driver for generating a gate driving voltage; a data driver for generating a data driving voltage based on the modulated odd and even REV signals received from the timing controller; and an LCD panel having a plurality of gate lines for transferring scanning signals, a plurality of data lines intersecting the gate lines for transferring image signals, a plurality of switching elements each formed in an area surrounded by the gate and data lines and connected to the gate and data lines, and a plurality of dot electrodes connected to the switching elements and operable in response to the operations of the switching elements, wherein the inversion drive repeats in a period of p frames based on the gate driving voltage and the data driving voltage (where p is an integer equal to or greater than 4), the inversion being shifted down by every line in a period of q frames according to a change in the frame, wherein q is less than p.

In still another aspect of the present invention to achieve the third object, there is provided an apparatus for driving an LCD having a multiframe inversion function, which includes a plurality of pixels arranged in a matrix form having a plurality of gate lines, a plurality of data lines insulated from and intersecting the gate lines, and a plurality of switching elements each formed in an area surrounded by the gate and data lines and connected to the gate and data lines, the apparatus including: a timing controller having a multiframe inversion driving portion for modulating an REV signal that designates a polarity of a data voltage for switching the polarity of liquid crystals on an LCD panel of the LCD with respect to a common electrode voltage, thereby generating a modulated REV signal; a gate driver for generating a gate driving voltage; and a data driver for generating a data driving voltage based on the modulated REV signal received from the timing controller.

In further another aspect of the present invention to achieve the fourth object, there is provided an apparatus for driving an LCD having a multiframe inversion function, which includes a plurality of pixels arranged in a matrix form having a plurality of gate lines, a plurality of data lines insulated from and intersecting the gate lines, and a plurality of switching elements each formed in an area surrounded by the gate line and the data lines and connected to the gate line and the data lines, the apparatus including: a timing controller having a multiframe inversion driving portion for modulating a REV signal that designates a polarity of a data voltage supplied to an LCD panel of the LCD, individually every odd/even column, and generating a modulated odd REV signal and a modulated even REV signal designating the polarities of odd and even data voltages, respectively; a gate driver for generating a gate driving voltage; and a data driver for generating a data driving voltage based on the modulated odd and even REV signals received from the timing controller.

In still further another aspect of the present invention to achieve the fifth object, there is provided a method for driving an LCD having a multiframe inversion function, which includes a plurality of pixels arranged in a matrix form having a plurality of gate lines, a plurality of data lines insulated from and intersecting the gate lines, and a plurality of switching elements each formed in an area surrounded by the gate lines and the data lines and connected to the gate lines and the data lines, the method including the steps of: (a) sequentially applying a scanning signal to the gate lines; (b) modulating an REV signal that designates a polarity of a data voltage for switching the polarity of liquid crystals on an LCD panel of the LCD with respect to a common electrode voltage, thereby generating a modulated REV signal; (c) generating a data driving voltage based on the modulated REV signal; and (d) applying the data driving voltage to the data lines.

In still further another aspect of the present invention to achieve the sixth object, there is provided a method for driving an LCD having a multiframe inversion function, which includes a plurality of pixels arranged in a matrix form having a plurality of gate lines, a plurality of data lines insulated from and intersecting the gate lines, and a plurality of switching elements each formed in an area surrounded by the gate lines and the data lines and connected to the gate lines and the data lines, the method including the steps of: (a) sequentially applying a scanning signal to the gate lines; (b) modulating a REV signal that designates a polarity of a data voltage supplied to an LCD panel of the LCD, individually every odd/even column, thereby generating a modulated odd REV signal and a modulated even REV signal designating the polarities of odd and even data voltages, respectively; (c) generating a data driving voltage based on the modulated REV signal; and (d) applying the data driving voltage to the data lines.

According to the LCD having a multiframe inversion function and a driving apparatus and method thereof, there can be removed flickering caused by dot inversion and horizontal lines from 2×1 dot inversion in driving the LCD.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 1 is a diagram explaining a dot inversion driving method in accordance with prior art;

FIG. 2 is a diagram explaining a 2×1 dot inversion driving method in accordance with prior art;

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 3:
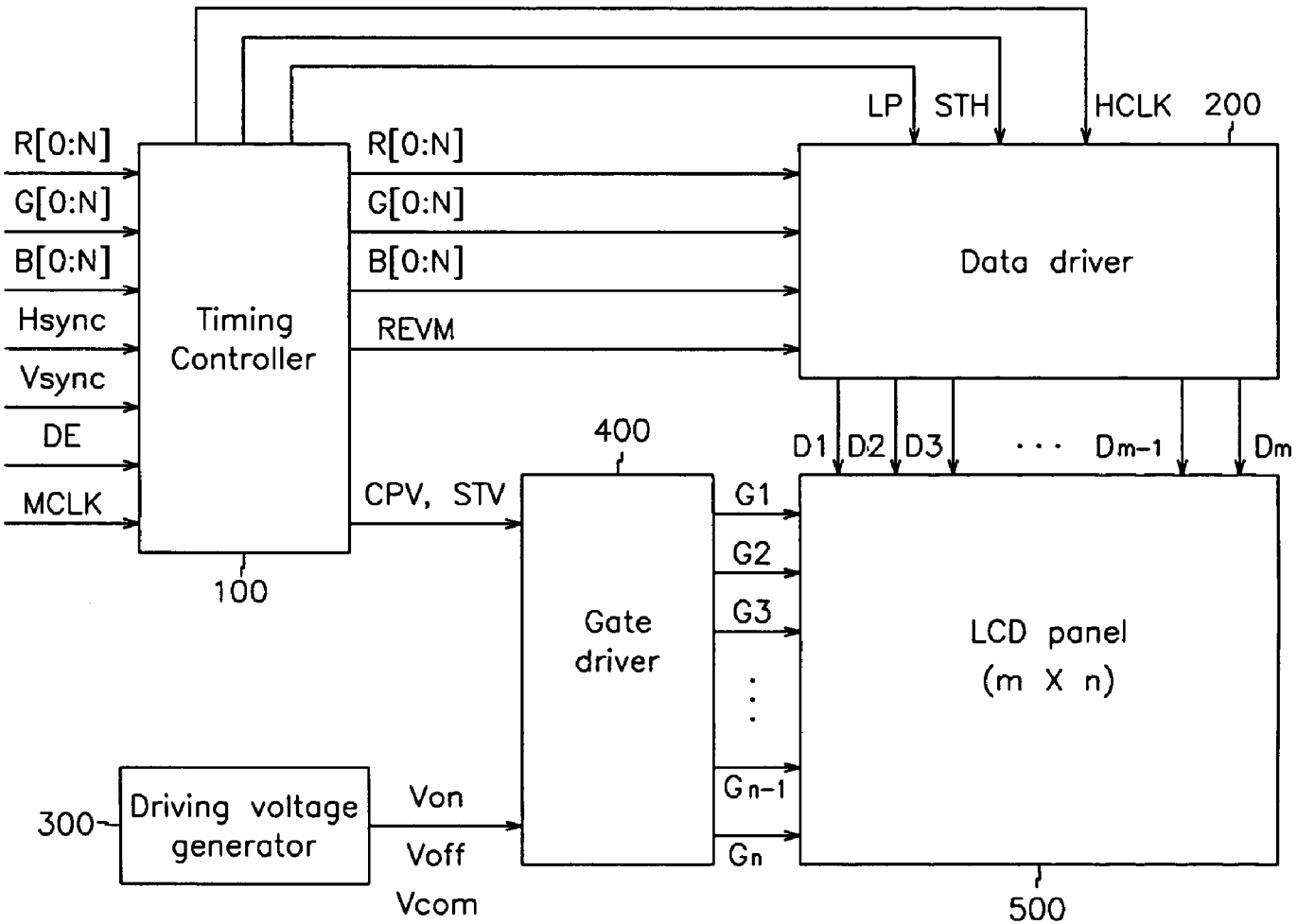
FIG. 3 is a diagram of an LCD having a multiframe inverting function in accordance with a first embodiment of the present invention.

FIG. 3 is a diagram of an LCD having a multiframe inverting function in accordance with a first embodiment of the present invention, i.e., a single bank type LCD having a multiframe inverting function.

Referring to FIG. 3, the LCD having a multiframe inverting function in accordance with the first embodiment of the present invention includes a timing controller 100, a data driver 200, a driving voltage generator 300, a gate driver 400, and an LCD panel 500.

The timing controller 100 receives, from an external graphic controller (not shown) of the LCD module, RGB data, frame-discriminating vertical sync signals Vsync, line-discriminating horizontal sync signals Hsync, main clock signals MCLK, and signals DE that become HIGH only in data output intervals in order to display data entrance areas, and generates digital signals for driving the data driver 200 and the gate driver 400.

More specifically, the timing controller 100 outputs to the data driver 200 an instruction signal STH for applying RGB digital signals R(0:N), G(0:N) and B(0:N) from the graphic controller to the data driver 200, an instruction signal LP for converting the digital data to the analog form at the data driver 200 and applying the analog values to the LCD panel 500, and a clock signal HCLK for data shift in the data driver 200.

The timing controller 100 also outputs to the gate driver 400 an instruction signal STV for applying a gate-on signal from the gate driver 400 to the gate lines in the LCD panel 500, and a gate clock signal (CPV: Clock Pulse for a Vertical clock signal) for sequentially applying the gate-on signal to the individual gate lines.

The timing controller 100 includes a single bank type multiframe inverting driver (not shown). The timing controller 100 modulates a REV signal that designates the polarity of a data voltage for switching the polarity of liquid crystals on the LCD panel with respect to a common electrode voltage $V_{com}$, and outputs a modulated REV signal REVM to the data driver 200.

The modulated REV signal REVM is a modulated signal upon which an inversion drive is carried out in a period of four frames in the LCD and shifted down every line according to a change in the frame.

The data driver 200 comprises shift register, data register, latch, level shifter, D/A converter, and output buffer, which are not shown in the figure. The data driver 200 stores the RGB digital signals R(0:N), G(0:N) and B(0:N) received from the timing controller 100 and, upon receiving the load instruction signal LP, outputs data voltages $D_1$, $D_2$, $D_3$, . . . , and $D_m$ for transferring selected voltages corresponding to the individual data to the LCD panel 500 based on the modulated REV signal REVM received from the timing controller 100.

More specifically, the D/A converter of the data driver 200 applies a "high" data voltage to the LCD panel 500 via the output buffer when the modulated REV signal REVM received from the timing controller 100 is "high", or a "low" data voltage to the LCD panel 500 via the output buffer when the modulated REV signal REVM is "low".

The driving voltage generator 300 outputs to the gate driver 400 a voltage $V_{on}$ for generating a gate-on signal, a voltage $V_{off}$ for generating a gate-off signal, and a common electrode voltage $V_{com}$ being a reference of the data voltage difference in the TFT'S.

The gate driver 400 includes a shift register (not shown), a level shifter (not shown) and a buffer (not shown). The gate driver 400 receives a gate clock signal CPV and a vertical line start signal STV from the timing controller 100, and voltages $V_{on}$, $V_{off}$ and $V_{com}$ from the driving voltage generator 300, and outputs gate voltages $G_1$, $G_2$, $G_3$, . . . , and $G_n$ to provide a path for applying the corresponding voltage values to the individual pixels on the LCD panel 500.

The LCD panel 500 includes a plurality of gate lines for transferring gate voltages $G_1$, $G_2$, $G_3$, . . . , and $G_n$ as scanning signals received from the gate driver 400, a plurality of data lines intersecting the gate lines and transferring data voltages $D_1$, $D_2$, $D_3$, . . . , and $D_n$ as image signals, a plurality of switching elements, i.e., TFT's each formed in an area surrounded by the gate lines and the data lines and connected to the gate and data lines, and a plurality of dot electrodes connected to the switching elements and operable in response to the operation of the switching elements.

The dot electrodes, each indicating any one of RGB dot electrodes, are continuously arranged in the matrix form, preferably, in a continuous array of R, G and B dots. As the gate voltages $G_1$, $G_2$, $G_3$, . . . , and $G_n$ are supplied from the gate driver 400 to the corresponding pixels, the dot electrodes drive the corresponding RGB dots provided therein in response to data voltages $D_1$, $D_2$, $D_3$, . . . , and $D_n$ from the data driver 200. The data voltages $D_1$, $D_2$, $D_3$, . . . , and $D_n$ are each output based on the polarity of the modulated REV signal REVM supplied from the timing controller 100.

Figures 4, 5:
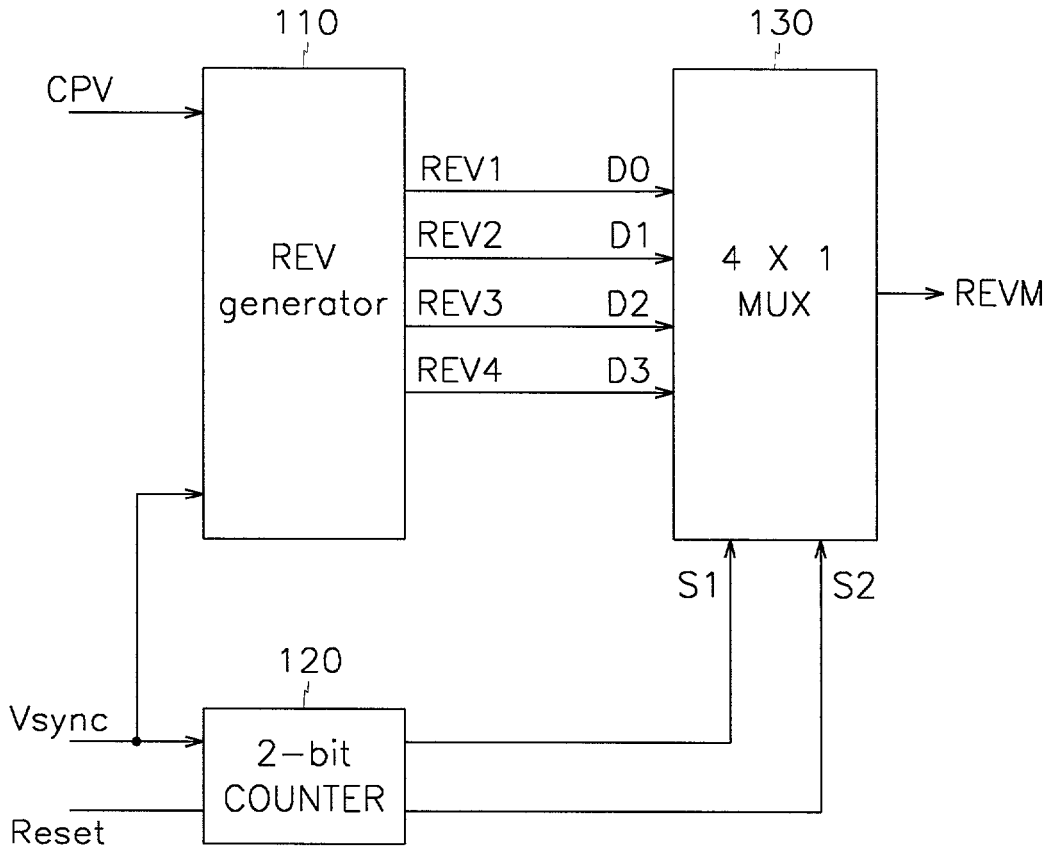
FIG. 4 is a diagram explaining a multiframe inversion driving method in accordance with the first embodiment of the present invention.
FIG. 5 is a diagram of a multiframe inversion driving portion in accordance with the first embodiment of the present invention.

FIG. 4 is a diagram explaining a multiframe inversion driving method in accordance with the first embodiment of the present invention.

Referring to FIG. 4, the inversion drive repeats in a period of four frames in contrast to the conventional inversion drive repeating in a period of two frames, and shifts down every one line as the frame changes.

The inversion in each frame occurs in the same manner as the 2×1 dot inversion so as to eliminate flickering that may take place in the dot pattern.

The head and tail of the data voltage waveform are alternately charged by frame, so that the brightness recognized by the observer's eyes is averaged to a constant value in both even lines and odd lines.

The above-described single bank type multiframe inversion driving method overcomes all problems indicated as the causes of the horizontal lines and provides an average brightness over time to prevent a brightness difference between the lines.

FIG. 5 is a diagram of a multiframe inversion driving portion in accordance with the first embodiment of the present invention.

Referring to FIG. 5, the multiframe inversion driving portion in accordance with the first embodiment of the present invention includes an REV generator 110, a counter 120, and a multiplexer 130, and outputs a modulated REV signal REVM based on a vertical sync signal Vsync indicating the period of the screen, and a gate clock signal CPV having the same period as the gate pulse width.

More specifically, the REV generator 110 generates first to fourth REV signals REV1, REV2, REV3 and REV4 from the vertical sync signal Vsync indicating the period of the screen, and a gate clock signal CPV having the same period as the gate pulse width.

The counter 120, preferably, 2-bit counter outputs 2-bit switching signals S1 and S2 to the multiplexer 130.

The multiplexer 130, preferably, 4×1 multiplexer selects every REV signal received from the REV generator 110 by period based on the 2-bit switching signals S1 and S2 to generate a modulated REV signal REVM. Because each of the REV signals repeats in a period of four frames, the vertical sync signal Vsync is processed at the 2-bit counter 120 and sent to the 4×1 multiplexer 130 to generate the modulated REV signal REVM in a desired pattern.

Although it has been described that this embodiment uses a 4×1 multiplexer with four inputs multiplexed based on the two-bit switching signals, and one output, it is obvious that an 8×1 multiplexer can be used if the individual REV signals repeat in a period of eight frames. The switching signals used in this case are, of course, 3-bit signals.

The CPV signal can be generated from the signal processors (not shown) of the data driver and the timing controller 100 that outputs a control signal requested by the data driver, based on a frame-discriminating vertical sync signal Vsync, a line-discriminating horizontal sync signal Hsync, a data enable signal DE, which is "high" only in a data output interval, and a clock signal.

The vertical sync signal Vsync can be externally supplied from the timing controller 100, preferably directly from the graphic controller, or generated based on the data enable signal DE.

Figure 6:
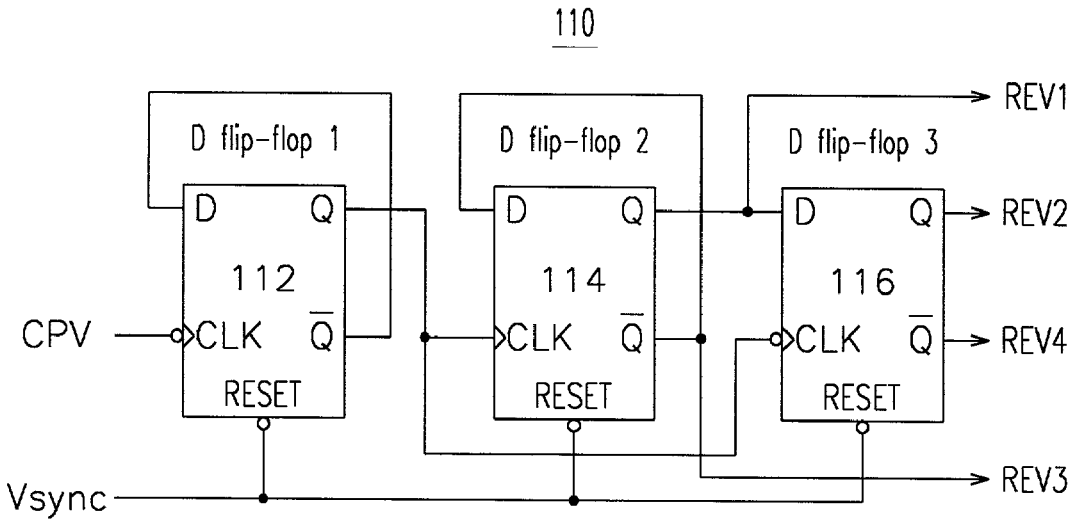
FIG. 6 is a diagram of the REV generator shown in FIG. 5.
Figure 7:
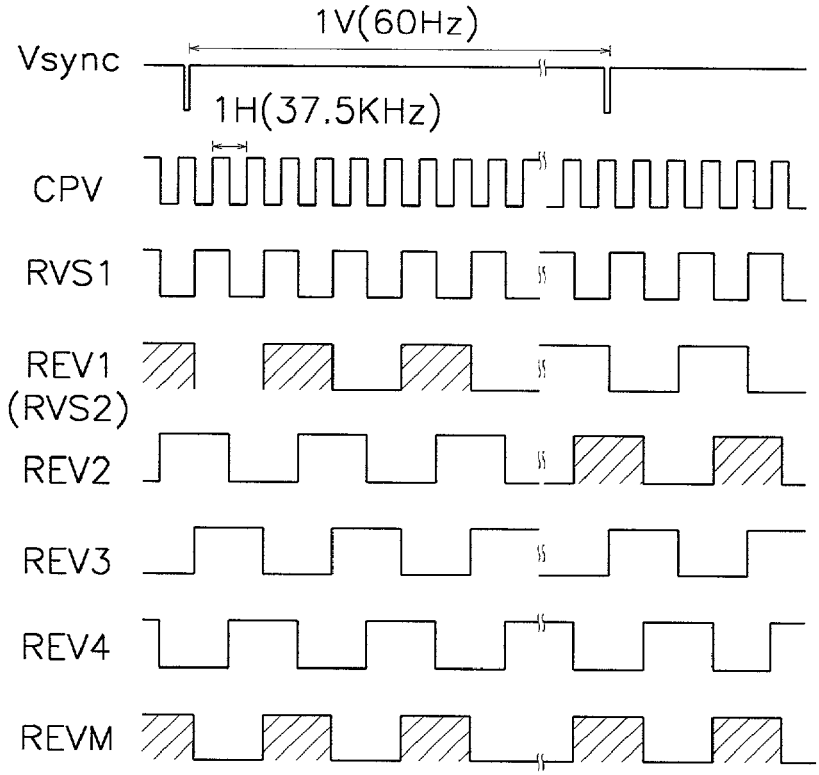
FIG. 7 is a waveform diagram of a multiframe inversion driving signal in accordance with the first embodiment of the present invention.

FIG. 6 is a diagram of the REV generator shown in FIG. 5, and FIG. 7 is a waveform diagram of a multiframe inversion driving signal in accordance with the first embodiment of the present invention.

Referring to FIG. 6, the REV generator 110 according to the first embodiment of the present invention comprises first, second and third D flipflops 112, 114 and 116.

Now, a description will be given as to the operation of the REV generator according to the first embodiment of the present invention with reference to FIGS. 6 and 7.

First, the three D flipflops 112, 114 and 116 are initialized based on the vertical sync signal Vsync, and the CPV signal is used to generate a waveform RVS1 as in the dot inversion and a waveform RVS2 as in the 2×1 dot inversion.

A first REV signal REV1 has the same waveform as a second REV signal RVS2 as shown in FIG. 7, and the second REV signal REV2 is formed from the first REV signal REV1 received via the third D flipflop 116. A third REV signal REV3, i.e., an inverted waveform of the first REV signal REV1 is output at /Q of the second D flipflop 114, while a fourth REV signal REV4, i.e., an inverted waveform of the second REV signal REV2 is output at /Q of the third D flipflop 116.

As described above, the first embodiment of the present invention performs a multiframe inversion driving process to prevent flickering in the dot pattern as well as horizontal lines that may be created during the 2×1 dot inversion.

Figure 8:
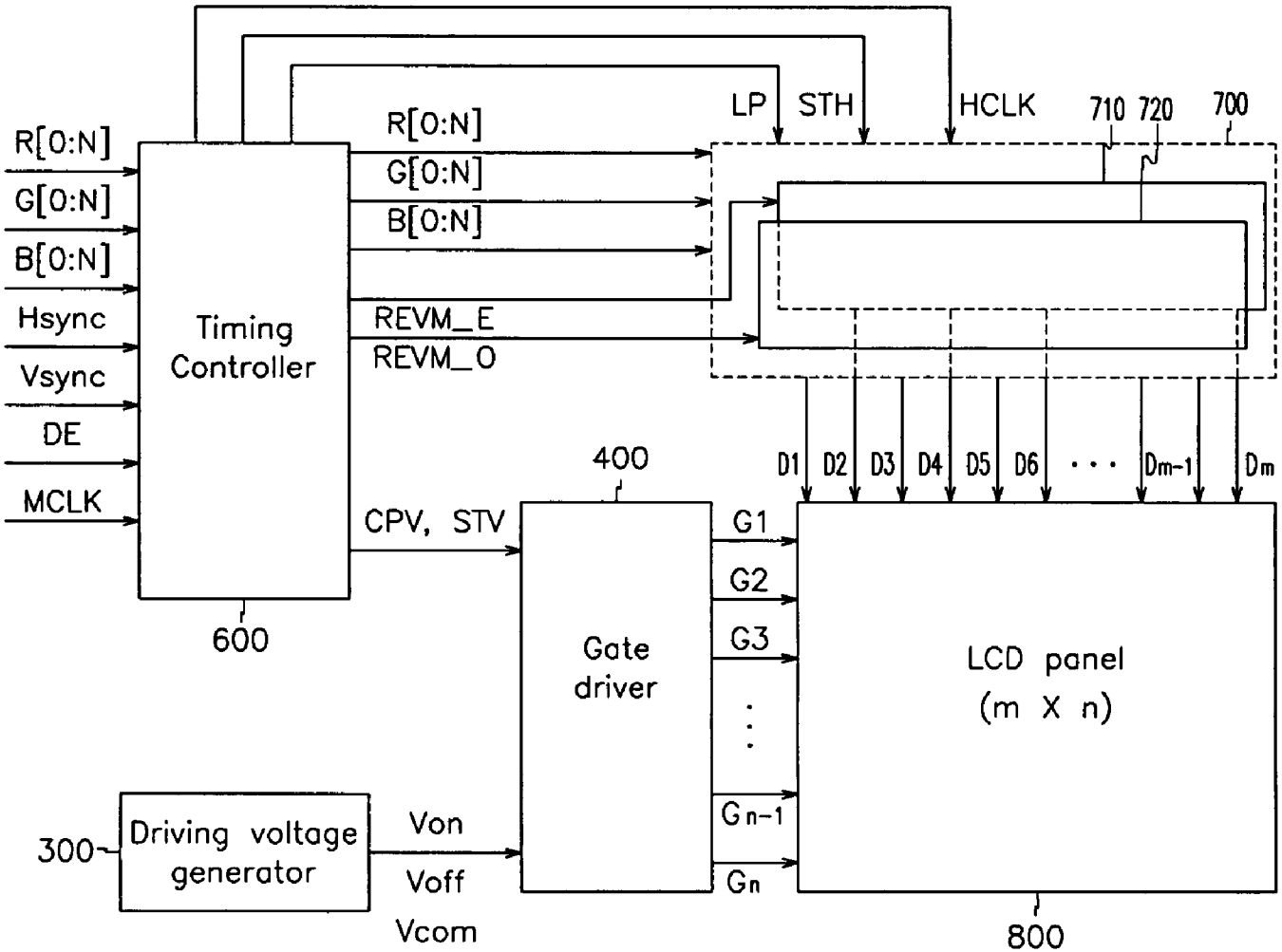
FIG. 8 is a diagram of an LCD having a multiframe inverting function in accordance with a second embodiment of the present invention.

FIG. 8 is a diagram of an LCD having a multiframe inverting function in accordance with a second embodiment of the present invention, i.e., a double bank type LCD having a multiframe inverting function.

Referring to FIG. 8, the LCD having a multiframe inverting function in accordance with the second embodiment of the present invention includes a timing controller 600, a data driver 700, a driving voltage generator 300, a gate driver 400, and an LCD panel 800.

The timing controller 600 receives, from an external graphic controller (not shown) of the LCD module, RGB data, frame-discriminating vertical sync signals Vsync, line-discriminating horizontal sync signals Hsync, main clock signals MCLK, and signals DE that become HIGH only in data output intervals in order to display data entrance areas, and generates digital signals for driving the data driver 700 and the gate driver 400.

More specifically, the timing controller 600 outputs to the data driver 700 an instruction signal STH for applying RGB digital signals R(0:N), G(0:N) and B(0:N) from the graphic controller to the data driver 700, an instruction signal LP for converting the digital data to the analog form at the data driver 700 and applying the analog values to the LCD panel 800, and a clock signal HCLK for data shift in the data driver 700.

The timing controller 600 also outputs to the gate driver 400 an instruction signal STV for applying a gate-on signal from the gate driver 400 to the gate lines in the LCD panel 800, and a gate clock signal CPV for sequentially applying the gate-on signal to the individual gate lines.

The timing controller 600 includes a dual bank type multiframe inverting driver (not shown). The timing controller 600 modulates, separately for even lines and odd lines, REV signals that designate the polarity of a data voltage for switching the polarity of liquid crystals on the LCD panel with respect to a common electrode voltage $V_{com}$, and outputs modulated even REV signals REVM_E and modulated odd REV signals REVM_O to the data driver 700.

The modulated odd REV signal REVM_O and the modulated even REV signals REVM_E are modulated signals upon which an inversion drive is carried out on the LCD for a period of four frames and shifted to the right side every column when switching from the first frame to the second one, every pixel as in the dot inversion method when switching from the second frame to the third one, and every column when switching from the third frame to the fourth one.

The data driver 700 comprises a first data driver 710 that outputs odd data voltages $D_1$, $D_3$, $D_5$, . . . , and $D_{m-1}$, and a second data driver 720 that outputs even data voltages $D_2$, $D_4$, $D_6$, . . . , and $D_m$ (where m is an even number). The data driver 700 stores the RGB digital signals R(0:N), G(0:N) and B(0:N) received from the timing controller 600 and, upon receiving the load instruction signal LP, outputs odd data voltages $D_1$, $D_3$, $D_5$, . . . , and $D_{m-1}$ and even data voltages $D_2$, $D_4$, $D_6$, . . . , and $D_m$ (wherein m is an even number) for transferring selected voltages corresponding to the individual data to the LCD panel 800 based on the modulated odd REV signals REVM_O and the modulated even REV signal REVM_E received from the timing controller 600.

The first data driver 710 and the second data driver 720 include shift register, data register, latch, level shifter, D/A converter, and output buffer, which are not shown in the figure.

More specifically, the D/A converter of the first data driver 710 applies a "high" data voltage to the LCD panel 800 via the output buffer when the modulated odd REV signal REVM_O received from the timing controller 600 is "high", or a "low" data voltage to the LCD panel 800 via the output buffer when the modulated odd REV signal REVM_O is "low".

The D/A converter of the second data driver 720 applies a "high" data voltage to the LCD panel 800 via the output buffer when the modulated even REV signal REVM_E received from the timing controller 600 is "high", or a "low" data voltage to the LCD panel 800 via the output buffer when the modulated even REV signal REVM_E is "low".

The driving voltage generator 300 outputs to the gate driver 400 a voltage $V_{on}$ for generating a gate-on signal, a voltage $V_{off}$ for generating a gate-off signal, and a common electrode voltage $V_{com}$ being a reference of the data voltage difference in the TFT's.

The gate driver 400 includes a shift register, a level shifter and a buffer. The gate driver 400 receives a gate clock signal CPV and a vertical line start signal STV from the timing controller 600, and voltages $V_{on}$, $V_{off}$ and $V_{com}$ from the driving voltage generator 300, and outputs gate voltages $G_1$, $G_2$, $G_3$, . . . , and $G_n$ to provide a path for applying the corresponding voltage values to the individual pixels on the LCD panel 800.

The LCD panel 800 includes a plurality of gate lines for transferring gate voltages $G_1$, $G_2$, $G_3$, . . . , and $G_n$ as scanning signals received from the gate driver 400, a plurality of data lines intersecting the gate lines and transferring odd data voltages $D_1$, $D_3$, $D_5$, . . . , and $D_{m-1}$ and even data voltages $D_2$, $D_4$, $D_6$, . . . , and $D_m$ (where m is an even number) as image signals, a plurality of switching elements, i.e., TFT's each formed in an area surrounded by the gate lines and the data line and connected to the gate lines and the data lines, and a plurality of dot electrodes connected to the switching elements and operable in response to the operation of the switching elements.

The dot electrodes, each indicating any one of RGB dot electrodes, are continuously arranged in the matrix form, preferably, in a continuous array of R, G and B dots. As the gate voltages $G_1$, $G_2$, $G_3$, . . . , and $G_n$ are supplied from the gate driver 400 to the corresponding pixels, the dot electrodes drive the corresponding RGB dots provided therein in response to odd data voltages $D_1$, $D_3$, $D_5$, . . . , and $D_{m-1}$ from the first data driver 710 of the data driver 700 and even data voltages $D_2$, $D_4$, $D_6$, . . . , and $D_m$ from the second data driver 720 of the data driver 700. The odd data voltages $D_1$, $D_3$, $D_5$, . . . , and $D_{m-1}$ and the even data voltages $D_2$, $D_4$, $D_6$, . . . , and $D_m$ are output based on the polarities of the modulated odd REV signal REVM_O and the modulated even REV signal REVM_E supplied from the timing controller 600, respectively.

Figures 9, 10:
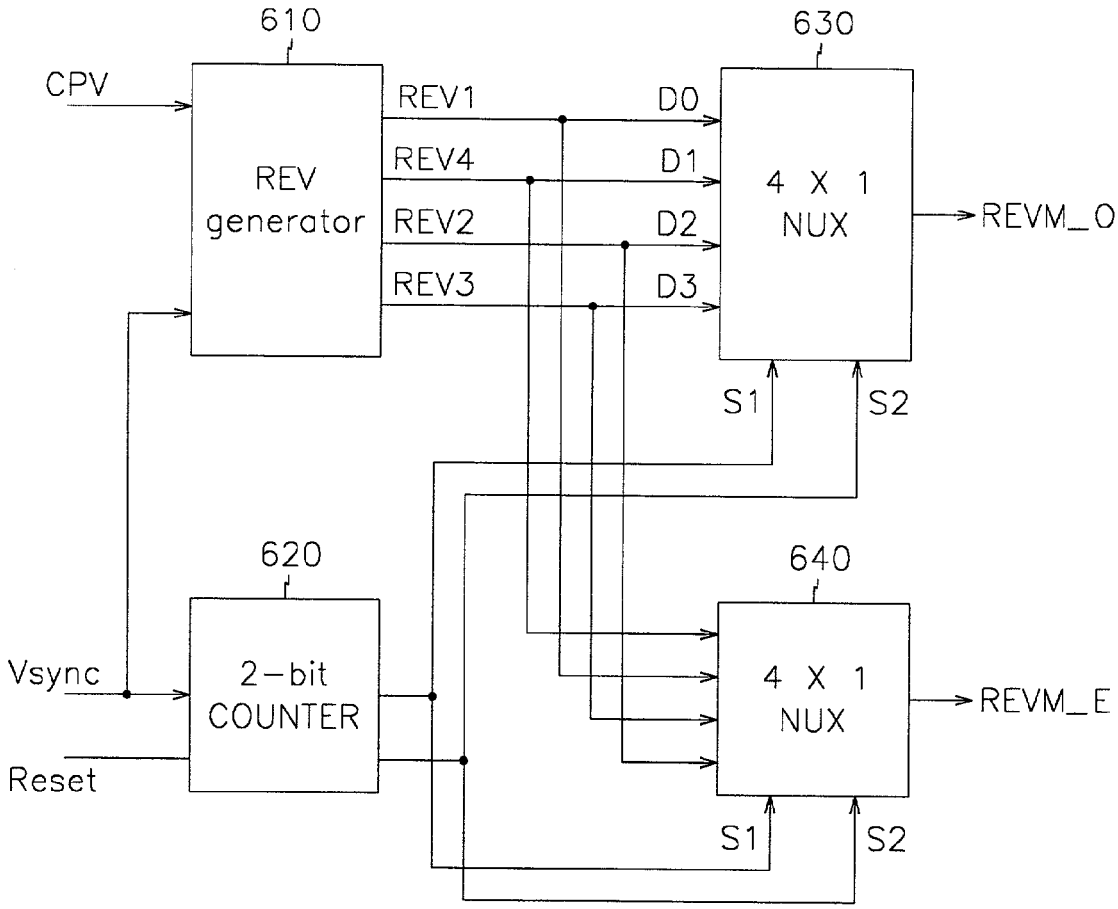
FIG. 9 is a diagram explaining a multiframe inversion driving method in accordance with the second embodiment of the present invention.
FIG. 10 is a diagram of a multiframe inversion driving portion in accordance with the second embodiment of the present invention.

FIG. 9 is a diagram explaining a multiframe inversion driving method in accordance with the second embodiment of the present invention.

Referring to FIG. 9, the inversion drive repeats in a period of four frames in contrast to the conventional inversion drive repeating in a period of two frames, and shifted down every line according to the change in the frame.

More specifically, the inversion shifts to the right side every column when switching from the first frame to the second one, every pixel as in the dot inversion method when switching from the second frame to the third one, and every column when switching from the third frame to the fourth one.

The inversion in each frame occurs in the same manner as the 2×1 dot inversion so as to eliminate flickering that may take place in the dot pattern.

The head and tail of the data voltage waveform are alternately charged by two frames, so that the brightness recognized by the observer's eyes is averaged to a constant value in both even lines and odd lines.

The above-described dual bank type multiframe inversion driving method overcomes all problems indicated as the causes of the horizontal lines and provides an average brightness over time to prevent a brightness difference between the lines.

FIG. 10 is a diagram of a multiframe inversion driving portion in accordance with the second embodiment of the present invention.

Referring to FIG. 10, the multiframe inversion driving portion in accordance with the second embodiment of the present invention includes an REV generator 610, a counter 620, a first multiplexer 630 and a second multiplexer 640, and outputs modulated odd REV signal REVM_O and modulated even REV signal REVM_E based on a vertical sync signal Vsync indicating the period of the screen, and a gate clock signal CPV having the same period as the gate pulse width.

More specifically, the REV generator 610 generates first to fourth REV signals REV1, REV2, REV3 and REV4 from the vertical sync signal Vsync indicating the period of the screen, and a gate clock signal CPV having the same period as the gate pulse width.

The counter 620, preferably, 2-bit counter outputs 2-bit switching signals S1 and S2 to the first and second multiplexers 630 and 640.

The first multiplexer 630, preferably, 4×1 multiplexer selects the individual REV signals REV1, REV2, REV3 and REV4 from the REV generator 610 by period based on the 2-bit switching signals S1 and S2 to generate modulated odd REV signals REVM_O.

The second multiplexer 640, preferably, 4×1 multiplexer selects the individual REV signals REV1, REV2, REV3 and REV4 from the REV generator 610 by period based on the 2-bit switching signals S1 and S2 to generate modulated even REV signals REVM_E.

Because each of the REV signals repeat in a period of four frames, the vertical sync signal Vsync is processed at the 2-bit counter 620 and sent to the 4×1 multiplexers 630 and 640 to generate the modulated REV signals in a desired pattern.

In the dual bank type system, the odd and even REV signals are output as presented in Table 1.

TABLE 1

| | REVM_O | REVM_E |
|---|---|---|
| FRAME 1 | REV1 | REV4 |
| FRAME 2 | REV4 | REV1 |
| FRAME 3 | REV2 | REV3 |
| FRAME 4 | REV3 | REV2 |
| FRAME 5 | REV1 | REV4 |

Although it has been described that this embodiment uses a 4×1 multiplexer with four inputs multiplexed based on the two-bit switching signals, and one output, it is obvious that an 8×1 multiplexer may also be used if the individual REV signals repeat in a period of eight frames. The switching signals used in this case are, of course, 3-bit signals.

The CPV signal can be generated from the signal processors (not shown) of the data driver and the timing controller 600 that outputs a control signal requested by the data driver, based on a frame-discriminating vertical sync signal Vsync, a line-discriminating horizontal sync signal Hsync, a data enable signal DE, which is "high" only in a data output interval, and a clock signal.

The vertical sync signal Vsync can be externally supplied from the timing controller 600, preferably directly from the graphic controller, or generated based on the data enable signal DE.

Figure 11:
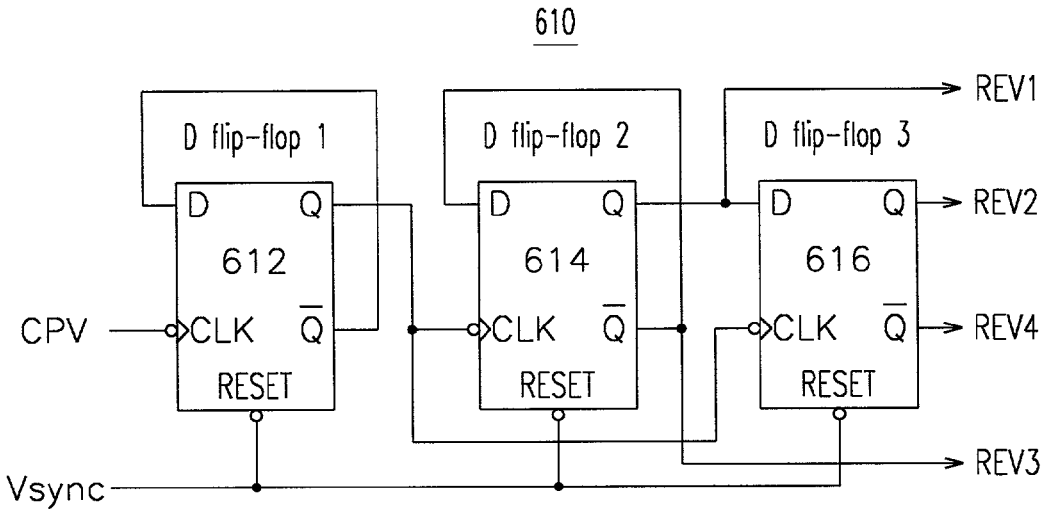
FIG. 11 is a diagram of the REV generator shown in FIG. 10.
Figure 12:
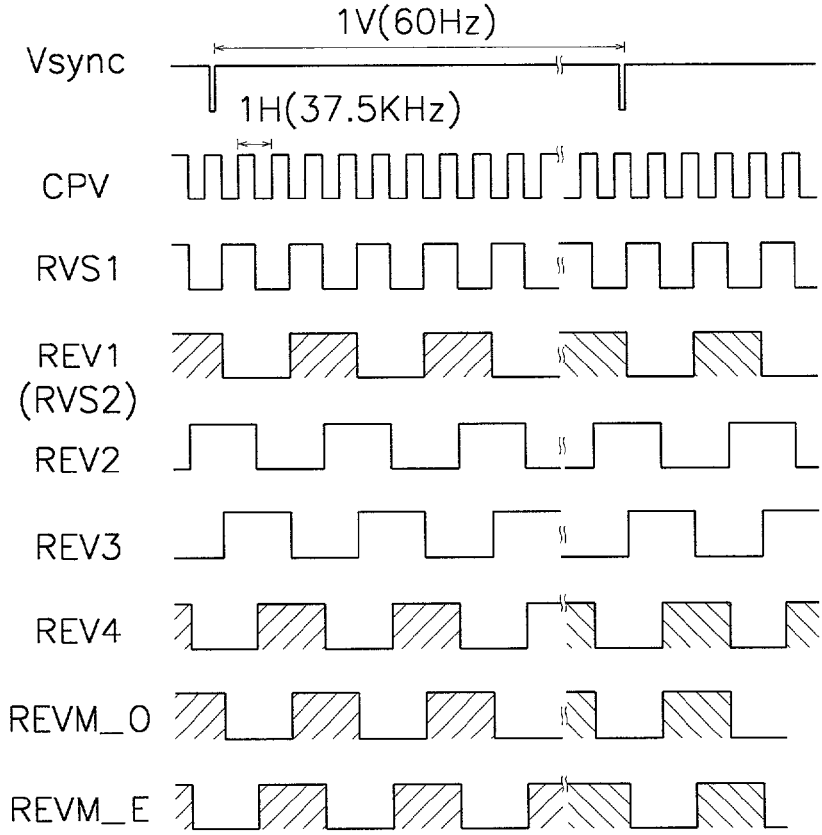
FIG. 12 is a waveform diagram of a multiframe inversion driving signal in accordance with the second embodiment of the present invention.

FIG. 11 is a diagram of the REV generator shown in FIG. 10, and FIG. 12 is a waveform diagram of a multiframe inversion driving signal in accordance with the second embodiment of the present invention.

Referring to FIG. 11, the REV generator 610 according to the second embodiment of the present invention comprises first, second and third D flipflops 612, 614 and 616.

Now, a description will be given as to the operation of the REV generator according to the second embodiment of the present invention with reference to FIGS. 11 and 12.

First, the three D flipflops 612, 614 and 616 are initialized based on the vertical sync signal Vsync, and the CPV signal is used to generate a waveform RVS1 as in the dot inversion and a waveform RVS2 as in the 2×1 dot inversion.

A first REV signal REV1 has the same waveform of a second REV signal RVS2 as shown in FIG. 12, and the second REV signal REV2 is formed from the first REV signal REV1 received via the third D flipflop 616. A third REV signal REV3, i.e., an inverted waveform of the first REV signal REV1 is output at /Q of the second D flipflop 614, while a fourth REV signal REV4, i.e., an inverted waveform of the second REV signal REV2 is output at /Q of the third D flipflop 616.

As described above, the second embodiment of the present invention independently processes odd REV signals REV_O for determining the polarity of the odd data lines and even REV signals REV_E for determining the polarity of the even data lines to more effectively enhance the flicker performance.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

As described above, the present invention can remove flickering in driving a single/dual bank type LCD by the dot inversion method.

The present invention can also remove horizontal lines in driving a single/dual bank type LCD by the 2×1 dot inversion method.

What is claimed is:

1. A liquid crystal display (LCD) having a multi-frame inversion function, comprising:

a timing controller having a multiframe inversion driving portion for modulating a reversal (REV) signal that designates a polarity of a data voltage for switching the polarity of liquid crystals on an LCD panel with respect to a common electrode voltage, thereby generating a modulated REV signal;

a gate driver for generating a gate driving voltage;

a data driver for generating a data driving voltage based on the modulated REV signal received from the timing controller; and an LCD panel having a plurality of gate lines, a plurality of data lines, a plurality of switching elements each formed in an area surrounded by the gate lines and the data lines and connected to the gate lines and the data lines, and a plurality of dot electrodes connected to the switching elements and operated in response to the switching elements, wherein inversion drive repeats in a period of p frames based on the gate driving voltage and the data driving voltage, and the inversion is performed by shifting down by every line in a period of one as the frame changes, and a plurality of REV signals have sequential 1/p phase differences.

2. The LCD as claimed in claim 1, wherein the multiframe inversion driving portion comprises:

a counter for generating a switching signal based on a vertical sync signal indicating a period of a screen;

an REV generator for generating first through $p^{th}$ REV signals based on the vertical sync signal and a gate clock signal; and a multiplexer for multiplexing the first through $p^{th}$ REV signals based on the switching signal to output a modulated REV signal to the data driver.

3. The LCD as claimed in claim 2, wherein the REV generator comprises:

a first negative polarity trigger for generating a first trigger signal based on the vertical sync signal and a CPV signal;

a first positive polarity trigger for generating a first REV signal and a third REV signal based on the vertical sync signal and the first trigger signal; and a second negative polarity trigger for generating a second REV signal and a fourth REV signal based on the first trigger signal, the first REV signal and the vertical sync signal.

4. The LCD as claimed in claim 3, wherein the trigger is a D flip-flop.

5. The LCD as claimed in claim 2, wherein the counter is a 2-bit counter.

6. The LCD as claimed in claim 1, wherein p is an integer equal to or greater than 4.

7. A liquid crystal display (LCD) having a multi-frame inversion function, comprising:

a timing controller having a multiframe inversion driving portion for separating REV signals that designate a polarity of a data voltage supplied to an LCD panel, individually by every odd/even column, and generating a modulated odd REV signal and a modulated even REV signal designating the polarities of odd data voltage and even data voltage, respectively;

a gate driver for generating a gate driving voltage;

a data driver for generating a data driving voltage based on the modulated odd REV signal and the modulated even REV signal received from the timing controller; and an LCD panel having a plurality of gate lines, a plurality of data lines, a plurality of switching elements each formed in an area surrounded by the gate lines and the data lines and connected to the gate lines and the data lines, and a plurality of dot electrodes connected to the switching elements and operating in response to the switching elements, wherein inversion drive repeats in a period of p frames based on the gate driving voltage and the data driving voltage, and the inversion is performed by shifting down by every line in a period of q frames as the frame changes, wherein q is less than p, and the REV siqnals have sequential 1/p phase differences.

8. The LCD as claimed in claim 7, wherein the multiframe inversion driving portion comprises:

a counter for generating a switching signal based on a vertical sync signal indicating the period of a screen;

an REV generator for generating first through $p^{th}$ REV signals based on the vertical sync signal and a gate clock signal;

a first multiplexer for multiplexing the first through $p^{th}$ REV signals based on the switching signal to output a modulated odd REV signal to the data driver; and a second multiplexer for multiplexing the first through $p^{th}$ REV signals based on the switching signal to output a modulated even REV signal to the data driver.

9. The LCD as claimed in claim 8, wherein the REV generator comprises:

a first negative polarity trigger for generating a first trigger signal based on the vertical sync signal and a CPV signal;

a first positive polarity trigger for generating a first REV signal and a third REV signal based on the vertical sync signal and the first trigger signal; and a second negative polarity trigger for generating a second REV signal and a fourth REV signal based on the first trigger signal, the first REV signal and the vertical sync signal.

10. The LCD as claimed in claim 8, wherein the counter is a 2-bit counter.

11. The LCD as claimed in claim 9, wherein the trigger is a D flipflop.

12. The LCD as claimed in claim 7, wherein p is an integer equal to or greater than 4.

13. An apparatus for driving a liquid crystal display (LCD) having a multi-frame inversion function, which includes a plurality of pixels arranged in a matrix form having a plurality of gate lines, a plurality of data lines insulated from the gate lines and intersecting the gate lines, and a plurality of switching elements each formed in an area surrounded by the gate lines and the data lines and connected to the gate lines and the data lines, the apparatus comprising:

a timing controller having a multiframe inversion driving portion for modulating an REV signal that designates a polarity of a data voltage for switching the polarity of liquid crystals on an LCD panel of the LCD with respect to a common electrode voltage, thereby generating a modulated REV signal;

a gate driver for generating a gate driving voltage; and a data driver for generating a data driving voltage based on the modulated REV signal received from the timing controller, wherein the multiframe inversion driving portion comprises:

a counter for generating a switching signal based on a vertical sync signal indicating the period of a screen;

an REV generator for generating first through $p^{th}$ REV signals based on the vertical sync signal and a gate clock signal; and a multiplexer for multiplexing the first throuah $p^{th}$ REV signals based on the switching signal to output a modulated REV signal to the data driver, wherein the first through $p^{th}$ REV signals have seguential 1/p phase differences.

14. The apparatus as claimed in claim 13, wherein p is an integer equal to or greater than 4.

15. The apparatus as claimed in claim 13, wherein the counter is a 2-bit counter.

16. The apparatus as claimed in claim 13, wherein the REV generator comprises:

a first negative polarity trigger for generating a first trigger signal based on the vertical sync signal and a CPV signal;

a first positive polarity trigger for generating a first REV signal and a third REV signal based on the vertical sync signal and the first trigger signal; and a second negative polarity trigger for generating a second REV signal and a fourth REV signal based on the first trigger signal, the first REV signal and the vertical sync signal.

17. The apparatus as claimed in claim 16, wherein the trigger is a D flip-flop.

18. An apparatus for driving a liquid crystal display (LCD) having a multiframe inversion function, which includes a plurality of pixels arranged in a matrix form having a plurality of gate lines, a plurality of data lines insulated from the gate lines and intersecting the gate lines, and a plurality of switching elements each formed in an area surrounded by the gate lines and the data lines and connected to the gate lines and the data lines, the apparatus comprising:

a timing controller having a multiframe inversion driving portion for modulating a REV signal that designates a polarity of a data voltage supplied to an LCD panel of the LCD, individually every odd/even column, and generating a modulated odd REV signal and a modulated even REV signal designating the polarities of odd data voltage and even data voltage, respectively;

a gate driver for generating a gate driving voltage; and a data driver for generating a data driving voltage based on the modulated odd REV signal and the modulated even REV signal received from the timing controller, wherein the multiframe inversion driving portion comprises:

a counter for generating a switching signal based on a vertical sync signal indicating the period of a screen;

an REV generator for generating first throuah $p^{th}$ REV signals based on the vertical sync signal and a gate clock signal;

a first multiplexer for multiplexing the first through $p^{th}$ REV signals based on the switching signal to output a modulated odd REV signal to the data driver; and a second multiplexer for multiplexing the first through $p^{th}$ REV signals based on the switching signal to output a modulated even REV signal to the data driver, wherein the first through $p^{th}$ REV signals have seguential 1/p phase differences.

19. The apparatus as claimed in claim 18, wherein the counter is a 2-bit counter.

20. The apparatus as claimed in claim 18, wherein p is an integer equal to or greater than 4.

21. The apparatus as claimed in claim 18, wherein the REV generator comprises:

a first negative polarity trigger for generating a first trigger signal based on the vertical sync signal and a CPV signal;

a first positive polarity trigger for generating a first REV signal and a third REV signal based on the vertical sync signal and the first trigger signal; and a second negative polarity trigger for generating a second REV signal and a fourth REV signal based on the first trigger signal, the first REV signal and the vertical sync signal.

22. The apparatus as claimed in claim 21, wherein the trigger is a D flip-flop.

23. A method for driving a liquid crystal disDlav (LCD) having a multiframe inversion function, which includes a plurality of pixels arranged in a matrix form having a plurality of gate lines, a plurality of data lines insulated from gate lines and intersecting the gate lines, and a plurality of switching elements each formed in an area surrounded by the gate lines and the data lines and connected to the gate lines and the data lines, the method comprising the steps of:

(a) sequentially providing a scanning signal to the gate lines;

(b) modulating an REV signal that designates a polarity of a data voltage for switching the polarity of liquid crystals on an LCD panel of the LCD with respect to a common electrode voltage, thereby generating a modulated REV signal;

(c) generating a data driving voltage based on the modulated REV signal; and (d) supplying the data driving voltage to the data lines, wherein a plurality of REV signals have sequential 1/p phase differences.

24. The method as claimed in claim 23, wherein the step (b) further comprises the steps of:

(b-1) generating a switching signal;

(b-2) generating at least one REV signal based on a frame-discriminating vertical sync signal and a gate clock signal; and (b-3) multiplexing the at least one REV signal based on the switching signal and outputting the same.

25. The method as claimed in claim 24, wherein the step (b-2) further comprises the steps of:

(b-21) generating a first trigger signal based on the frame-discriminating vertical sync signal and the gate clock signal;

(b-22) generating a first REV signal a third REV signal based on the gate clock signal and the first trigger signal, the first REV signal being opposite to the third REV signal in polarity; and (b-23) generating a second REV signal and a fourth REV signal based on the gate clock signal, the first REV signal and the first trigger signal, the second REV signal being opposite to the fourth REV signal in polarity.

26. A method for driving a liquid crystal displav (LCD) having a multiframe inversion function, which includes a plurality of pixels arranged in a matrix form having a plurality of gate lines, a plurality of data lines insulated from and intersecting the gate lines, and a plurality of switching elements each formed in an area surrounded by the gate line and the data line and connected to the gate line and the data line, the method comprising the steps of:

(a) sequentially supplying a scanning signal to the gate lines;

(b) modulating an REV signal that designates a polarity of a data voltage supplied to an LCD panel of the LCD, individually every odd/even column, thereby generating a modulated odd REV signal and a modulated even REV signal designating the polarities of odd data voltage and even data voltage, respectively;

(c) generating a data driving voltage based on the modulated REV signal; and (d) supplying the data driving voltage to the data lines, wherein a plurality of REV signals have sequential 1/p phase differences.

27. The method as claimed in claim 26, wherein the step (b) comprises the steps of:

(b-1) generating a switching signal;

(b-2) generating at least one REV signal based on a frame-discriminating vertical sync signal and a gate clock signal;

(b-3) first multiplexing at least one REV signal based on the switching signal to generate an odd REV signal; and (b-4) second multiplexing at least one REV signal based on the switching signal to generate an even REV signal.

28. The method as claimed in claim 27, wherein the first multiplexing step includes generating an odd REV signal designating the polarity of the odd data voltage individually separating the LCD panel by every odd column.

29. The method as claimed in claim 27, wherein the second multiplexing step includes generating an even REV signal designating the polarity of the even data voltage individually separating the LCD panel by every even column.

* * * * *